US006543511B2

(12) United States Patent
Niermann

(10) Patent No.: US 6,543,511 B2
(45) Date of Patent: Apr. 8, 2003

(54) TAPE DISPENSER

(76) Inventor: Volker Niermann, 196B Main St., Little Falls, NJ (US) 07424-1432

( * ) Notice: Subject to any disclaimer, the term of this patent is extended or adjusted under 35 U.S.C. 154(b) by 0 days.

(21) Appl. No.: 09/728,462

(22) Filed: Dec. 1, 2000

(65) Prior Publication Data

US 2002/0069974 A1 Jun. 13, 2002

(51) Int. Cl.[7] ..... B32B 31/00

(52) U.S. Cl. ..... 156/527; 156/577; 156/579; 206/411; 225/46; 225/56

(58) Field of Search ..... 156/574, 577, 156/579, 527; 225/46, 56, 57; 206/411; D19/67

(56) References Cited

U.S. PATENT DOCUMENTS

| | | | | | |
|---|---|---|---|---|---|
| 2,167,908 | A | * | 8/1939 | Richards | 242/588.6 |
| 2,760,573 | A | * | 8/1956 | Guyot | 225/10 |
| D201,766 | S | * | 7/1965 | Perkins | D19/67 |
| 3,839,127 | A | | 10/1974 | Hazuka et al. | |
| 3,895,059 | A | | 7/1975 | Link | |
| 4,059,210 | A | | 11/1977 | Deering, Jr. | |
| 4,175,685 | A | | 11/1979 | Niles | |
| 4,238,272 | A | | 12/1980 | Schleicher | |
| 4,262,835 | A | | 4/1981 | Wrobel | |
| 4,320,835 | A | * | 3/1982 | Polhemus et al. | 206/214 |
| 4,341,587 | A | | 7/1982 | Regan | |
| 4,344,813 | A | | 8/1982 | Holoff et al. | |
| 4,400,231 | A | | 8/1983 | Martin | |
| 4,591,407 | A | | 5/1986 | Samuelson | |
| 4,623,421 | A | | 11/1986 | Cardin | |
| 4,627,560 | A | | 12/1986 | Samuelson | |
| 4,729,518 | A | | 3/1988 | Mathna et al. | |
| 4,762,586 | A | | 8/1988 | Wilkie | |
| 4,780,172 | A | | 10/1988 | Shea | |
| 5,076,883 | A | * | 12/1991 | Bosley | 156/522 |
| 5,083,717 | A | | 1/1992 | Samuelson et al. | |
| 5,118,381 | A | * | 6/1992 | Ryder et al. | 156/289 |
| D342,093 | S | | 12/1993 | Samuelson | |
| 5,294,068 | A | | 3/1994 | Baro et al. | |
| 5,328,115 | A | | 7/1994 | Samuelson et al. | |
| 5,342,466 | A | | 8/1994 | Eidson | |
| 5,358,113 | A | * | 10/1994 | Hellenbrand | 206/409 |
| 5,363,997 | A | | 11/1994 | Harris | |
| 5,393,368 | A | | 2/1995 | Stevens | |
| 5,490,898 | A | | 2/1996 | Koyama | |
| 5,556,469 | A | | 9/1996 | Koyama et al. | |
| 5,595,626 | A | | 1/1997 | Yokouchi et al. | |
| 5,628,867 | A | * | 5/1997 | Renaud | 156/524 |
| 5,662,578 | A | | 9/1997 | Phelps | |
| 5,759,270 | A | * | 6/1998 | Lee | 118/200 |
| 5,759,341 | A | | 6/1998 | Kobayashi | |
| 5,820,005 | A | | 10/1998 | Perkitny et al. | |
| 5,820,728 | A | | 10/1998 | Stevens et al. | |
| 5,861,080 | A | | 1/1999 | Yang et al. | |
| 5,942,036 | A | | 8/1999 | You | |
| 6,062,286 | A | | 5/2000 | Koyama et al. | |
| 6,079,660 | A | * | 6/2000 | Manusch et al. | 156/577 |
| 6,112,796 | A | | 9/2000 | Stevens | |

* cited by examiner

*Primary Examiner*—Mark A. Osele

(57) ABSTRACT

A dispenser is provided for adhesive tape. The dispenser includes a tape roll chamber with a hub having an axis about which a roll of tape may rotate. A tape dispensing channel extends from the tape roll chamber. The tape dispensing channel is configured to twist the tape approximately 90° about its longitudinal axis. Additionally, the tape dispensing channel is oriented such that the axis of the tape at the end of the tape dispensing channel is aligned at an acute angle to a plane defined by the axis of the tape wound onto the roll of tape. A window is defined near the end of the tape dispensing channel to enable an index finger to apply pressure to the non-adhesive surface of the tape for urging the adhesive surface of the tape against a substrate. A blade support wall is disposed distally of the window and includes a serrated blade for severing the tape. The lower surface of the blade support wall is arcuately configured for sliding along the applied tape for urging the tape into secure adhesion with the substrate.

17 Claims, 12 Drawing Sheets

TAPE DISPENSER

BACKGROUND OF THE INVENTION

1. Field of the Invention

The subject invention relates to tape dispensers, and particularly to a tape dispenser that facilitates single-handed use.

2. Description of the Related Art

Adhesive tape is a long thin flexible strip with opposite longitudinal side edges and a longitudinal axis centrally between the side edges. The strip of tape is wound around a spool for storage, shipment, sale and use. The spool has opposite ends and a rotational axis that extends between the ends. The tape is wound onto the spool such that the side edges of the tape register with the ends of the spool. Additionally, the longitudinal axis of the wound tape defines a plane that is orthogonal to the rotational axis of the spool. The combination of the tape and the spool is referred to as a roll.

A roll of adhesive tape typically is mounted in a dispenser. The typical dispenser includes at least one side wall aligned substantially perpendicular to the axis of the spool. The side wall includes structure for rotatably maintaining the spool in the dispenser. The typical adhesive tape dispenser further includes a metal or plastic serrated cutting blade. The cutting blade is mounted to a portion of the dispenser spaced from the spool and typically is aligned parallel to the rotational axis of the spool. A portion of the adhesive side of the tape may be supported and releasably retained on the cutting blade of the dispenser.

The tape may be used by grabbing a portion of the tape with a thumb and forefinger at a location between the spool and the cutting blade. Forces generated by the fingers then separate the tape from the cutting blade and enable the tape to be pulled relative to the dispenser. These pulling forces cause the spool to rotate in the prior art tape dispenser, and permit the tape to be dispensed. After a sufficient length of tape has been pulled from the spool, the user then engages a portion of the tape slightly beyond the cutting blade and urges the tape against the cutting blade with sufficient force to sever the tape at a location adjacent the cutting blade. The severed section of tape then is applied to a substrate as needed. Portions of the tape on the spool side of the cutting blade will remain adhered to the cutting blade for the next dispensing operation.

The typical prior art tape dispenser is not well suited for single-handed use. In particular, a small tape dispenser must be gripped by one hand while the other hand engages the tape and pulls the tape from the blade and beyond the dispenser. The one hand remains on the dispenser and the other hand remains on the tape as the tape is severed. A two-handed dispensing of tape can be carried out fairly easily with a small tape dispenser and for a small piece of tape (e.g., 1–2 inches). In particular, the hand that pulls the tape typically will not have to be repositioned to urge the tape against the blade. The dispensing becomes much more difficult if a longer piece of tape is required. In particular, to dispense a long piece of tape, the tape is first grabbed between the blade and the spool and separated from the blade. The user then pulls a sufficient length of tape from the spool and urges the tape against the blade. The hand that had pulled the tape then must be removed from the free end of the tape to engage the tape at a location closer to the blade. This causes the free end of the tape to move, often in response to electrostatic forces. The free end of the tape often will adhere to itself or to an unintended surface.

The above-described complications can be avoided with a large heavy tape dispenser that has a broad base. This type of prior art tape dispenser can be supported without being gripped manually. Hence, the tape can be pulled from the dispenser with one hand, thereby leaving the other hand free for some other purpose, such as holding the object to be taped. Additionally, two hands can be employed, if necessary, to hold both ends of a long piece of tape.

Both the lightweight and the heavy typical prior art tape dispenser have the problem of manually gripping the adhesive surface of the tape at least once to dispense the tape. This manual gripping reduces the adhesiveness and may transfer soil from the finger to the adhesive side of the tape. The soil, often in the form of a fingerprint, remains on the tape and is visible on the object to which the tape is applied.

It often would be desirable to apply the tape directly from the dispenser to the object being taped. The large heavy prior art tape dispenser that is suitable for some single-handed use cannot conveniently be positioned adjacent the object to which the tape is to be applied. The lighter weight disposable tape dispenser can be manipulated fairly easily. However, the shape of the prior art tape dispenser is not well suited to direct application of the tape from the dispenser to the object being taped. In particular, the tape leaving the dispenser typically defines a plane that extends either through or parallel to the rotational axis of the spool. Thus, the portion of the tape in proximity to the cutting blade typically will be offset from the surface being taped by a distance approximately equal to the radial distance from the axis of rotation to the outside of the tape dispenser. Conceivably, the light weight tape dispenser can be manipulated so that the tape bends about an axis transverse to the longitudinal direction of the tape. This causes an inconvenient angular orientation of the tape dispenser, and typically moves the tape a distance further from the cutting blade than would normally be obtained during a tape dispensing operation. An extremely complicated maneuver of the tape dispenser then would be required to employ the cutting blade and sever the tape. An attempt to use the prior art tape dispenser in this manner typically would require the tape to be cut at a considerable distance from the surface being taped, and hence would require a difficult estimate of the amount of tape that is required to be cut. Through all of this maneuvering, all portions of the tape typically are aligned approximately parallel to the axis of the spool, with the longitudinal axis of the tape defining a single plane that is orthogonal to the rotational axis of the spool.

The prior art includes some tape dispensers where the tape is twisted approximately 90° about the longitudinal axis of the tape as the tape is being dispensed. These prior art tape dispensers also have the longitudinal axis of the tape lying in a single plane that is orthogonal to the rotational axis of the spool. Examples of such prior art tape dispensers are shown, for example, in U.S. Pat. Nos. 5,393,368, 5,595,626, 5,759,341, 6,062,286 and 6,112,796. Additionally, U.S. Pat. No. 5,490,898 shows a tape dispenser where the amount of twist of the tape about the longitudinal axis of the tape can be varied.

Several of the above-described tape dispensers are intended for tapes that have a carrier strip. Thus, these prior art tape dispensers include take-up reels, and means for delivering the carrier strip from the dispensing end of the dispenser back to the take-up reel. None of the prior art identified above is well suited to single handed dispensing. In particular, these prior art dispensers still require the tape dispenser to be held with one hand and the leading end of the tape to be gripped with the other hand for application to the object to be taped. Thus, the problems of reduced adhesiveness and fingerprints on the tape remain. Additionally, the angle of the dispenser during use is not ideal for directly dispensing the tape to the substrate. Thus, inconvenient manipulation of the tape dispenser is required for both the dispensing and the severing of the tape.

SUMMARY OF THE INVENTION

The subject invention is directed to a dispenser for a flexible tape, such as a flexible adhesive tape. The adhesive tape is a long narrow strip of thin flexible material that has a length many times greater than the width. The tape has opposite side edges extending along the length of the tape and a longitudinal axis centrally between the side edges. The tape is stored on and dispensed from a cylindrical spool. The spool has a smooth cylindrical inner surface and a smooth cylindrical outer surface that is concentric with the inner surface. The inner and outer surfaces are concentric about a rotational axis for the spool. The tape is wound onto the spool such that the opposed side edges of the tape substantially register with the respective axial ends of the spool. Additionally, the longitudinal axis of the wound tape defines a plane substantially perpendicular to the rotational axis of the spool.

The tape dispenser of the subject invention may be molded from a plastic material to include a hub, a tape roll chamber surrounding the hub, a dispensing channel extending from the tape roll chamber and a blade at the end of the dispensing channel remote from the tape roll chamber.

The hub of the dispenser is smoothly cylindrical and defines an outside diameter less than the inside diameter of the spool of the roll of tape. The hub further defines a central axis. The spool can be mounted rotatably on the hub such that the rotational axis of the spool is substantially concentric with the central axis of the hub. Thus, the longitudinal axis of the tape wound on the spool will define a plane that is substantially perpendicular to the central axis of the hub.

The tape-dispensing channel includes an upstream end adjacent the tape roll chamber, a downstream end adjacent the blade and a transition section between the upstream and downstream ends. The upstream end of the dispensing channel is configured to receive a section of the tape that defines a plane aligned substantially parallel to the axis of the hub. The downstream end of the tape-dispensing channel is configured to receive a section of the tape aligned substantially perpendicular to the section of the tape in the upstream end of the tape dispensing channel. The transition section of the tape-dispensing channel is configured to twist the tape approximately 90° about the longitudinal axis of the tape. The plane defined by tape in the downstream end of the tape-dispensing channel is aligned to the axis of the hub at an acute angle, and preferably an angle of between about 75° and 50°. Additionally, the longitudinal axis of portions of the tape disposed in the downstream end of the tape-dispensing channel is aligned at an acute angle of about 15–40° to the plane defined by the longitudinal axis of the tape wound around the spool.

The cutting blade is substantially orthogonal to the axis of the hub and is substantially parallel to the plane defined by the longitudinal axis of portions of the tape wound onto the spool. Additionally, the blade preferably is parallel to and offset from radially aligned planes at either end of the spool.

The downstream end of the tape-dispensing channel preferably comprises a window that extends substantially from the blade to the transition section of the tape-dispensing channel. The window enables the user of the device to apply a finger to the non-adhesive side of the tape at a location substantially adjacent the cutting blade. The finger then can be used to urge the adhesive side of the tape toward and into contact with a substrate to be taped.

The tape dispenser further includes a curved trap between the window and the transition section of the tape-dispensing channel. The curved trap will urge the tape into a slightly arched side-to-side configuration at locations that overlie the window. The arched configuration enables the tape to be cantilevered from the convex wall across the window and toward the blade.

The above-described configuration enables portions of the tape dispenser that define the tape roll chamber to be gripped by a thumb and several forefingers, with the index finger directed toward the window. The above-described acute angle relationship between the tape in the downstream section of the tape-dispensing channel and the longitudinal axis of the tape wound on the spool enables tape in the downstream end of the tape-dispensing channel to be close to the substrate to be taped. The index finger then can be urged against the non-adhesive side of the tape positioned in the window. Forces exerted by the index finger can urge the adhesive side of the tape against the substrate to be taped. The user then merely guides the dispenser along the substrate to be taped. When the blade approximately aligns with the end of the area to be taped, the user merely rotates his or her hand to urge the blade into the tape. Thus, the tape can be severed at substantially the precise location desired, without complex maneuvering of the dispenser. Throughout the entire tape dispensing operation, the downstream end of the tape dispensing channel, and specifically the window portion of the tape dispensing channel can be positioned on or substantially adjacent the substrate to be taped.

DETAILED DESCRIPTION OF THE PREFERRED EMBODIMENT

Figure 1:
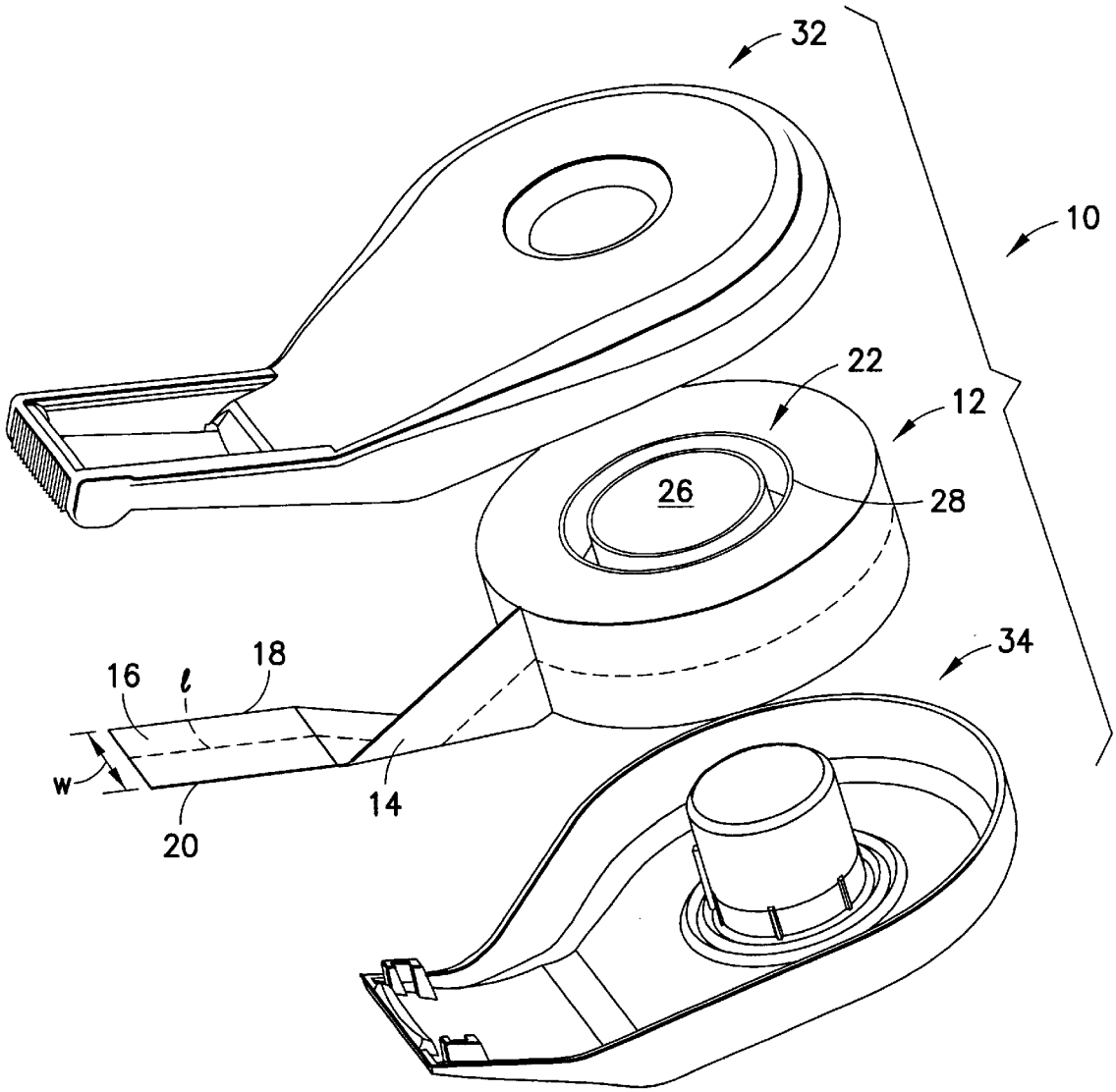
FIG. 1 is an exploded perspective view of a tape dispenser in accordance with the subject invention, as viewed from the top.
Figure 2:
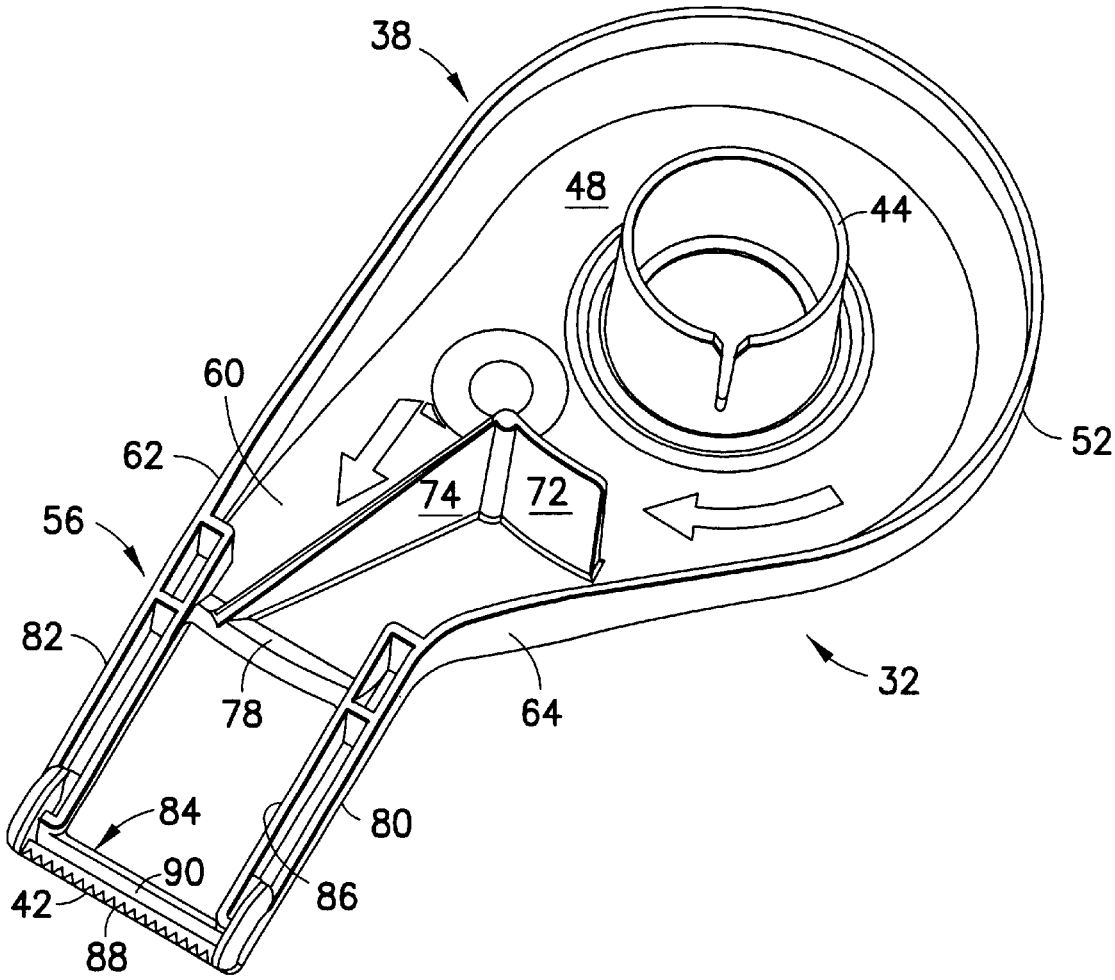
FIG. 2 is a perspective view of the top casing of the tape dispenser in an inverted orientation.
Figure 3:
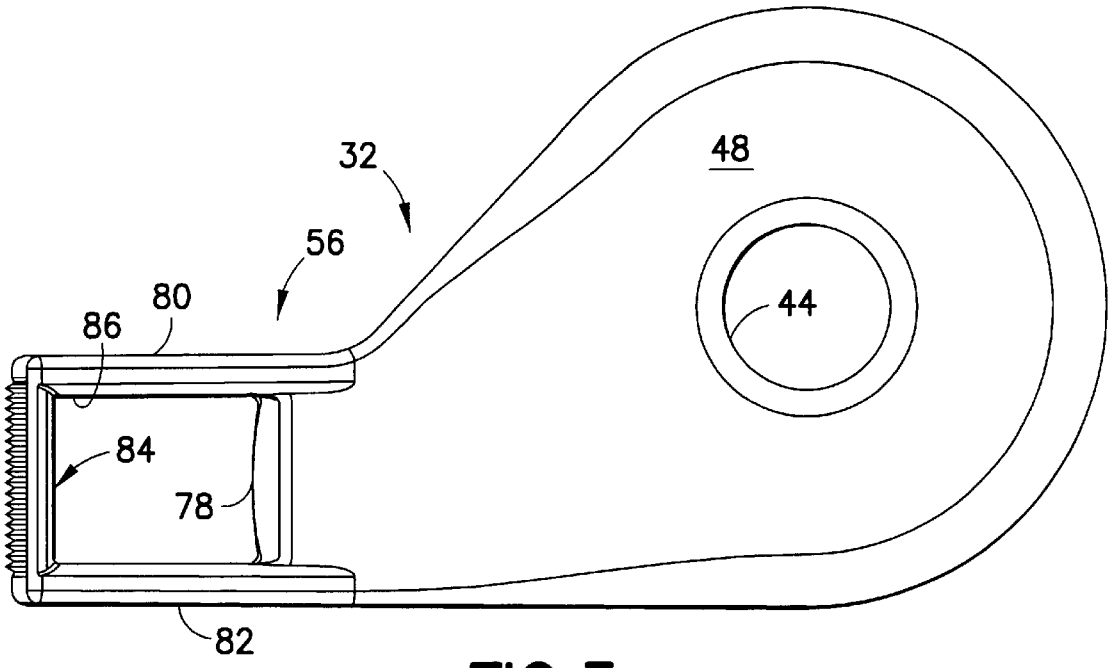
FIG. 3 is a top plan view of the top casing of the tape dispenser.
Figure 4:
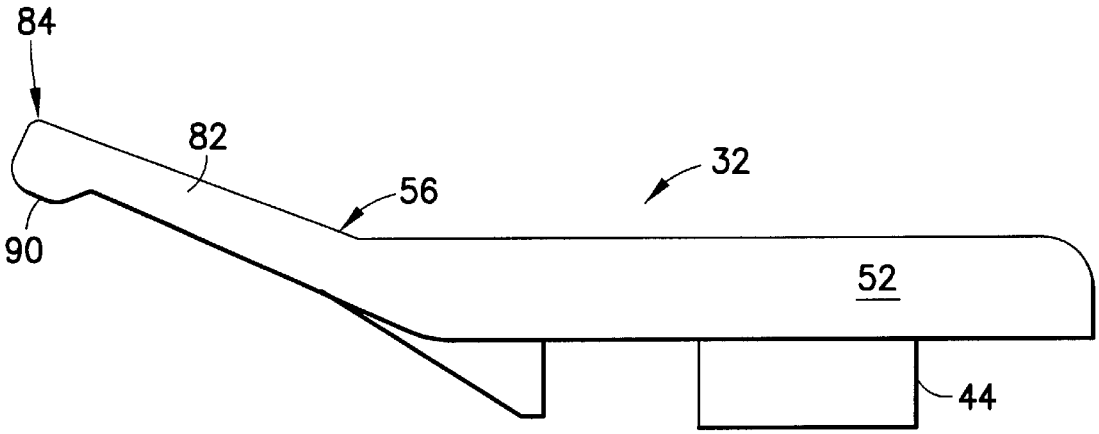
FIG. 4 is a side elevational view of the top casing of the tape dispenser.
Figure 5:
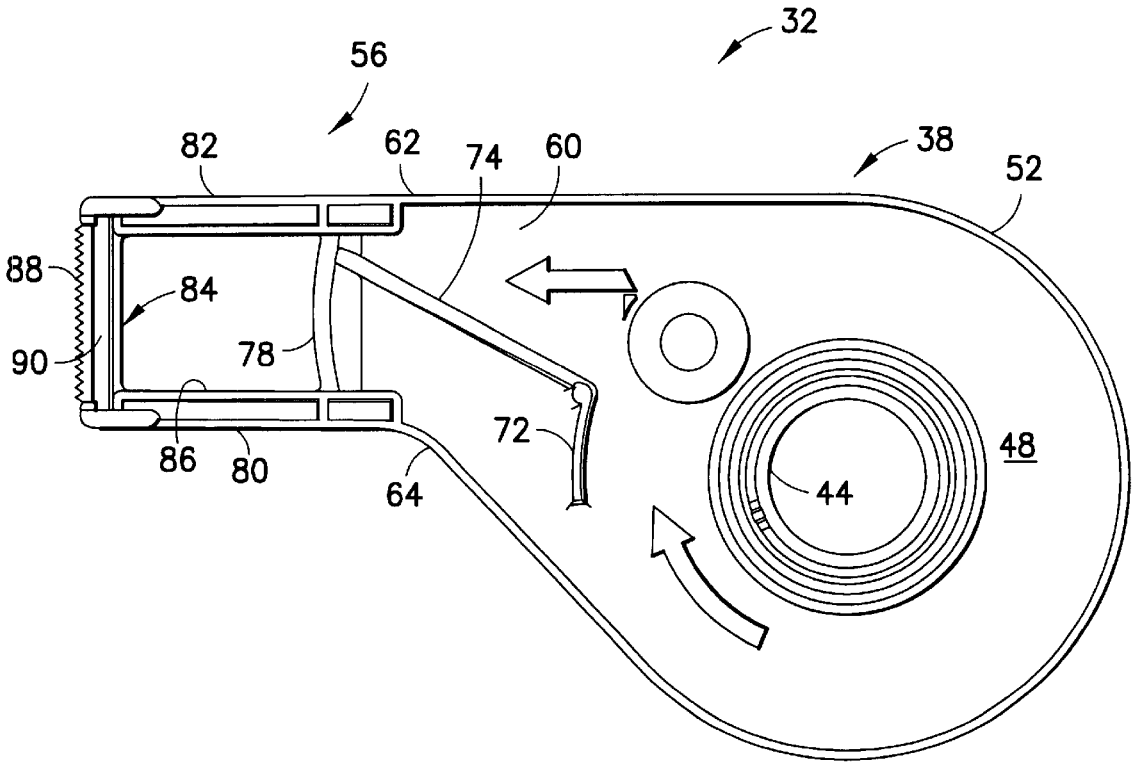
FIG. 5 is a bottom plan view of the top casing.
Figure 6:
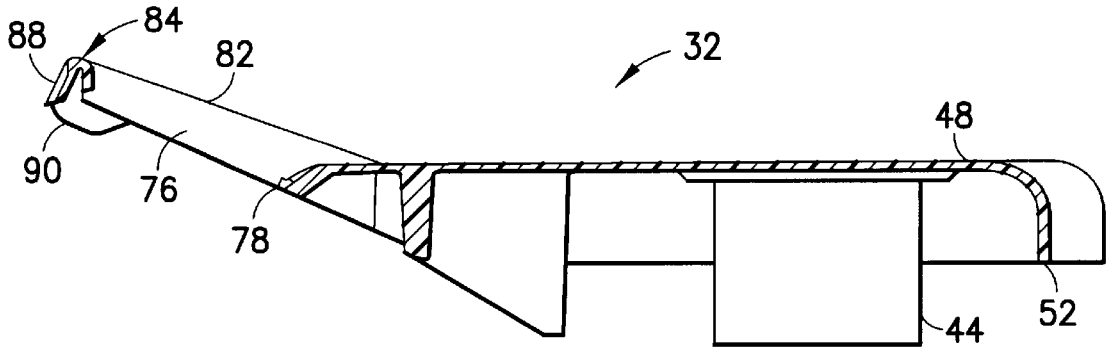
FIG. 6 is a cross-sectional view taken along line 6—6 in FIG. 3.
Figure 7:
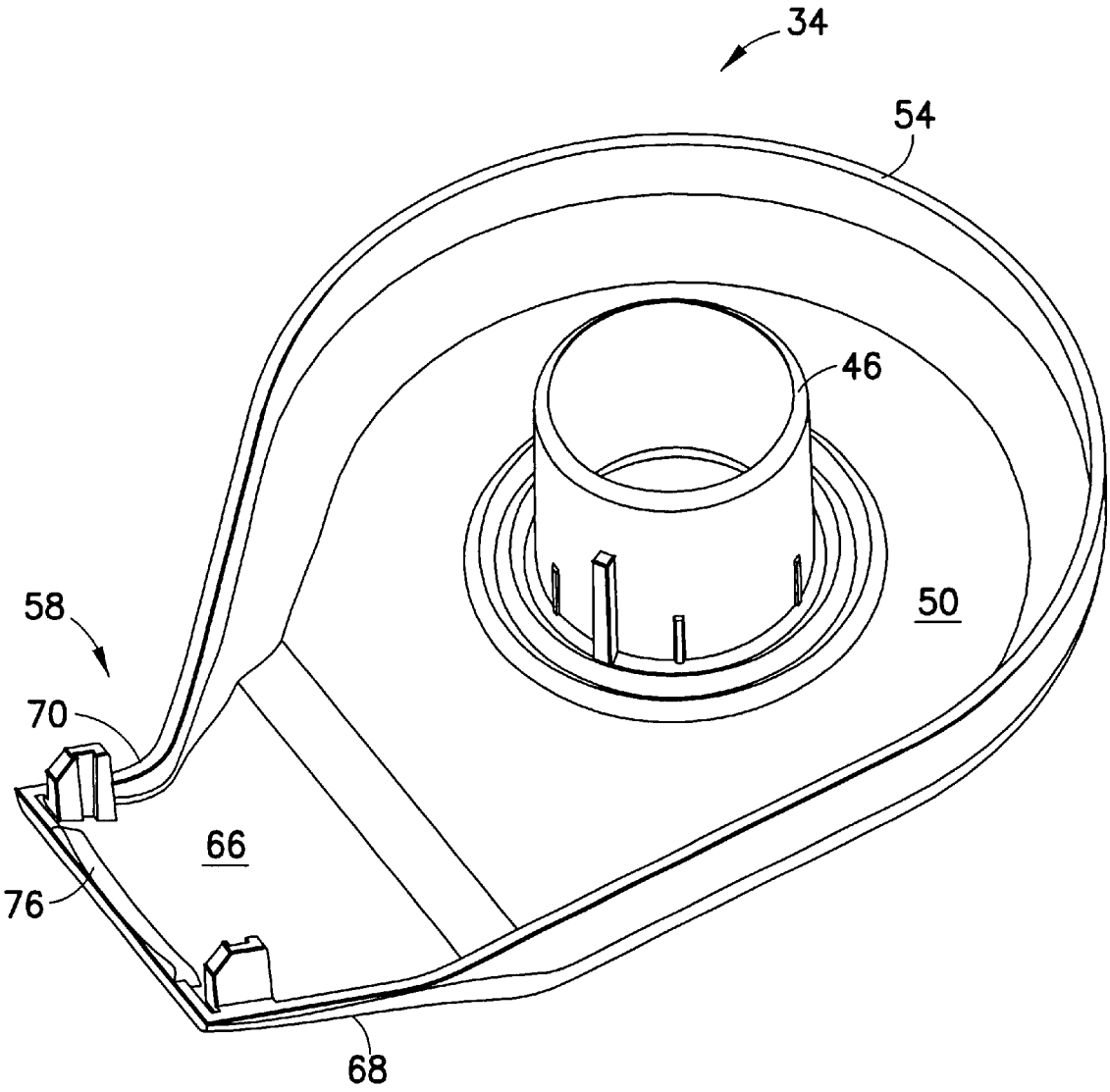
FIG. 7 is a perspective view of the bottom casing of the dispenser.

A tape dispenser in accordance with the subject invention is identified generally by the numeral 10 in FIGS. 1 and 11–16. The dispenser 10 is intended for use with adhesive tape 12. The adhesive tape 12 is a long thin flexible strip having an adhesive surface 14 and a non-adhesive surface 16. The strip of adhesive tape 12 further includes opposed longitudinal side edges 18 and 20 defining a width "w" for the tape 12. A longitudinal axis "l" extends along the tape 12 centrally between the side edges 18 and 20. The longitudinal axis "l" defines a length for the tape 12 that is many times greater than its width "w".

The tape 12 is wound onto a cylindrical spool 22. The spool 22 has cylindrical outer and inner surfaces 24 and 26 that are concentric with one another and that are generated about a common axis "x". The spool 22 further has opposed axial ends 28 and 30 that are spaced from one another by a distance "w" approximately equal to the width "w" of the adhesive tape 12.

The adhesive tape 12 is wound onto the outer cylindrical surface 24 of the spool 22 such that the adhesive surface 14 of the tape 12 faces inwardly and such that the opposed side edges 18 and 20 of the tape 12 register with the opposed ends 28 and 30 respectively of the spool 22. In this wound condition, the longitudinal axis "l" of the tape 12 defines a plane that is perpendicular to the axis "x" of the spool 22.

The tape dispenser 10 includes opposed upper and lower casings 32 and 34 that can be engaged releasably with one another. The upper and lower casings each are unitarily molded from a plastic material. The assembled upper and lower casings 32 and 34 of the dispenser 10 define a cylindrical hub 36, a cylindrical tape roll chamber 38 surrounding the hub 36, a tape-dispensing channel 40 extending from the tape roll chamber 38 and a blade 42 at the end of the tape-dispensing channel 40 remote from the tape roll chamber 38. The hub 36 is defined by an outer hub sleeve 44 on the upper casing 32 and an inner hub sleeve 46 on the lower casing 34. The inner and outer hub sleeves 44 and 46 are telescoped with one another as the upper and lower casings 32 and 34 are assembled. The outer hub sleeve 44 has an outside diameter slightly less than the inside diameter of the inner circumferential surface 26 of the spool 22. Additionally, the assembled inner and outer spool sleeves 44 and 46 define a combined length for the spool 36 that is slightly greater than the width "w" of the tape 12 and the length of the spool 22.

Figure 14:
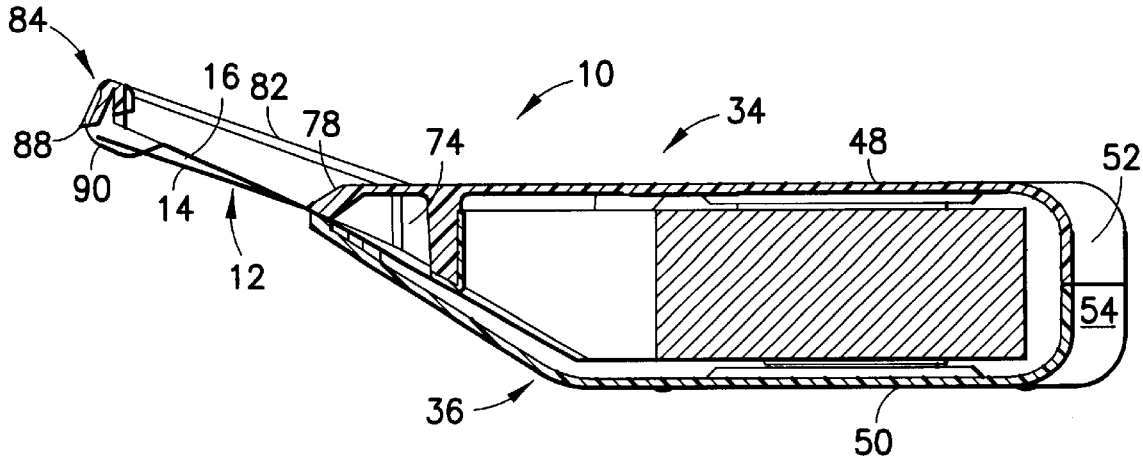
FIG. 14 is a cross-sectional view taken along line 14—14 in FIG. 11.
Figure 13:
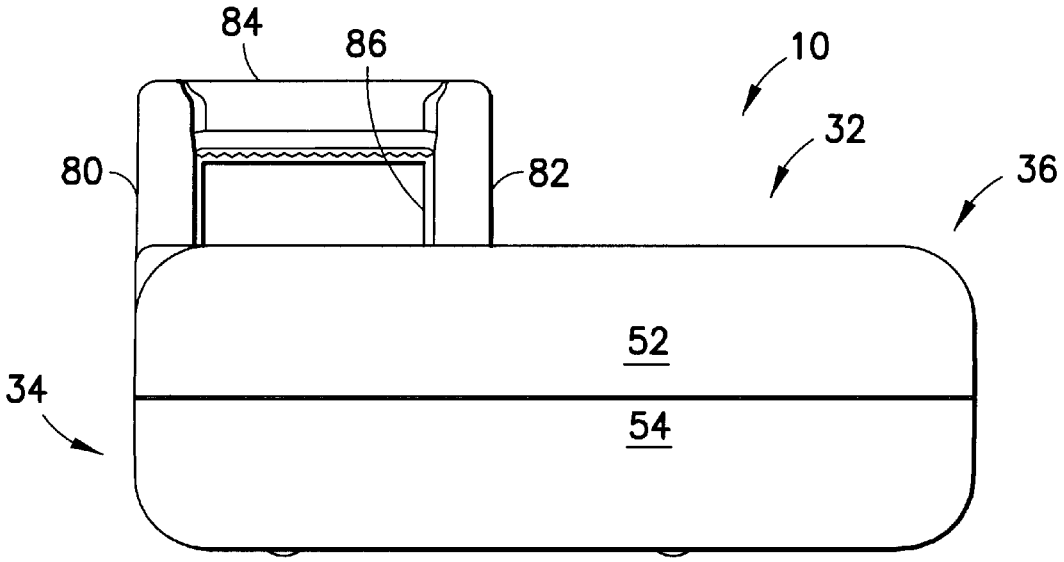
FIG. 13 is an end elevational view of the dispenser.
Figure 15:
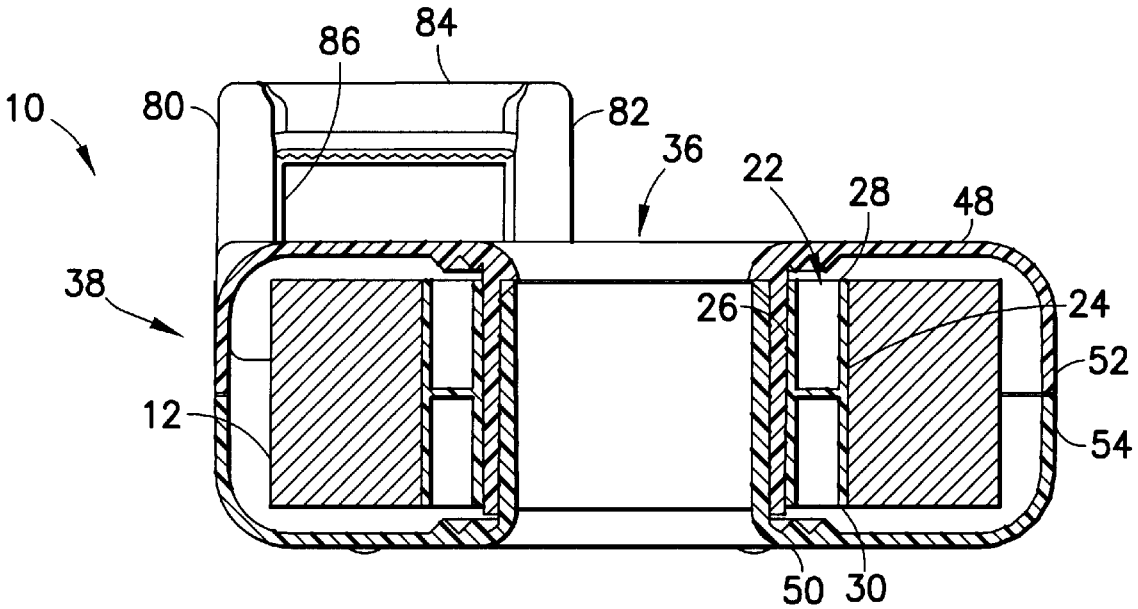
FIG. 15 is a cross-sectional view taken along line 15—15 in FIG. 12.

The tape roll chamber 38 is dimensioned and shaped to be gripped by one hand and defines a radial dimension greater than the radial dimension of a full roll of the tape 12. Thus, a full roll of the tape 12 can be rotated about the hub 36 and within the tape roll chamber 38 for selectively dispensing the tape 12 from the dispenser 10. The tape roll chamber 38 is further defined by top and bottom walls 48 and 50 on the upper and lower casings 32 and 34 respectively. The top and bottom walls 48 and 50 are substantially parallel to one another on the assembled dispenser 10 and lie on opposite respective axial ends of the roll of the tape 12. Top and bottom side walls 52 and 54 project orthogonally from the respective top and bottom walls 48 and 50 and substantially abut one another when the upper and lower casings 32 and 34 are assembled as shown in FIG. 14. The top and bottom side walls 52 and 54 define the outer circumferential portions of the tape roll chamber 38, and hence will lie radially outwardly from a full roll of the tape 12.

The tape-dispensing channel 40 is disposed outwardly from the tape roll chamber 38 and communicates with the tape roll chamber 38. More particularly, the tape-dispensing channel 40 includes an upper channel 56 and a lower channel 58. The upper channel 56 comprises a top wall 60, an outer side wall 62 and an inner side wall 64. The lower channel 58 comprises a bottom wall 66, an outer side wall 68 and an inner side wall 70. The upper and lower channels 56 and 58 are configured such that the inner and outer side walls 68 and 70 of the lower U-shaped channel 58 register with the inner and outer side walls 62 and 64 of the upper U-shaped channel 56. However, the upper channel 56 extends further from the tape roll chamber 38 than the extension of the lower channel 58 from the tape roll chamber 38.

The registered and aligned outer side walls 62 and 68 of the tape dispensing channel 40 extend tangentially from the outer circumferential side walls 52 and 54 of the tape roll chamber 38. The registered and aligned inner side walls 64 and 70 of the tape dispensing channel begins in tangential alignment with the outer circumferential side walls 52 and 54 of the tape roll chamber 38, and hence converge toward the outer side walls 62 and 68. However, the inner side walls 64 and 70 then curve into substantially parallel alignment with the registered and aligned outer side walls 62 and 68 of the tape dispensing channel 40 at a location where the internal spacing between the registered and aligned outer side walls 62 and 68 and the registered and aligned inner side walls 64 and 70 is slightly greater than the width "w" of the tape.

The top wall 60 of the upper channel 56 is aligned to the top wall 48 of the tape roll chamber 38 at an angle of less than 24°, and preferably approximately 20°. The bottom wall 66 of the lower channel 58 is aligned to the bottom wall 50 of the tape roll chamber 38 at an angle slightly less than 31°, but slightly greater than the angle between the top walls 60 and 48. Hence, in the illustrated embodiment the bottom wall 66 of the lower channel 58 converges toward the top wall 60 of the upper channel 56. However such convergence is not essential.

The tape-dispensing channel 40 is separated partly from the tape roll chamber 38 by a support rib 72 formed on the upper casing 32 and substantially concentric with the axis "x" of the hub 36. The tape-dispensing channel 40 is further characterized by a twist-generating wall 74 that extends continuously from the support rib 72. The twist-generating wall 74 is substantially planar and defines a plane substantially parallel to but offset from the axis "x" of the hub 36. The twist-generating wall 74 converges toward the top wall 60 of the upper channel 56 at locations further from the tape roll chamber 38. The twist-generating wall 74 terminates at a location that substantially registers with the end of the lower channel 58.

Trap walls 76 and 78 are defined at locations near the end of the lower channel 58. More particularly, a concave lower trap wall 76 extends transversely across the end of the lower channel 58 remote from the roll chamber 36. A complimentary convex upper trap wall 78 extends transversely across the upper channel 56 at a location registered with the concave trap wall 76. A curved space is defined between the registered lower and upper trap walls 76 and 78, and the tape 12 may pass through the curved space. The trap walls 76 and 78 impart to the tape 12 a transverse arch that helps to support the tape 12 as explained further herein.

The upper channel 56 includes two parallel arms 80 and 82 that extend beyond the arched transverse upper trap wall 78. Ends of the arms 80 and 82 furthest from the tape roll chamber 38 are connected by a blade support 84. The blade support 84 extends substantially parallel to the transverse arched upper trap wall 78 and substantially perpendicular to the arms 80 and 82. Thus, a substantially rectangular window 86 is defined between the arm 80 and 82, the convexly arched upper trap wall 78 and the blade support wall 84.

Figure 8:
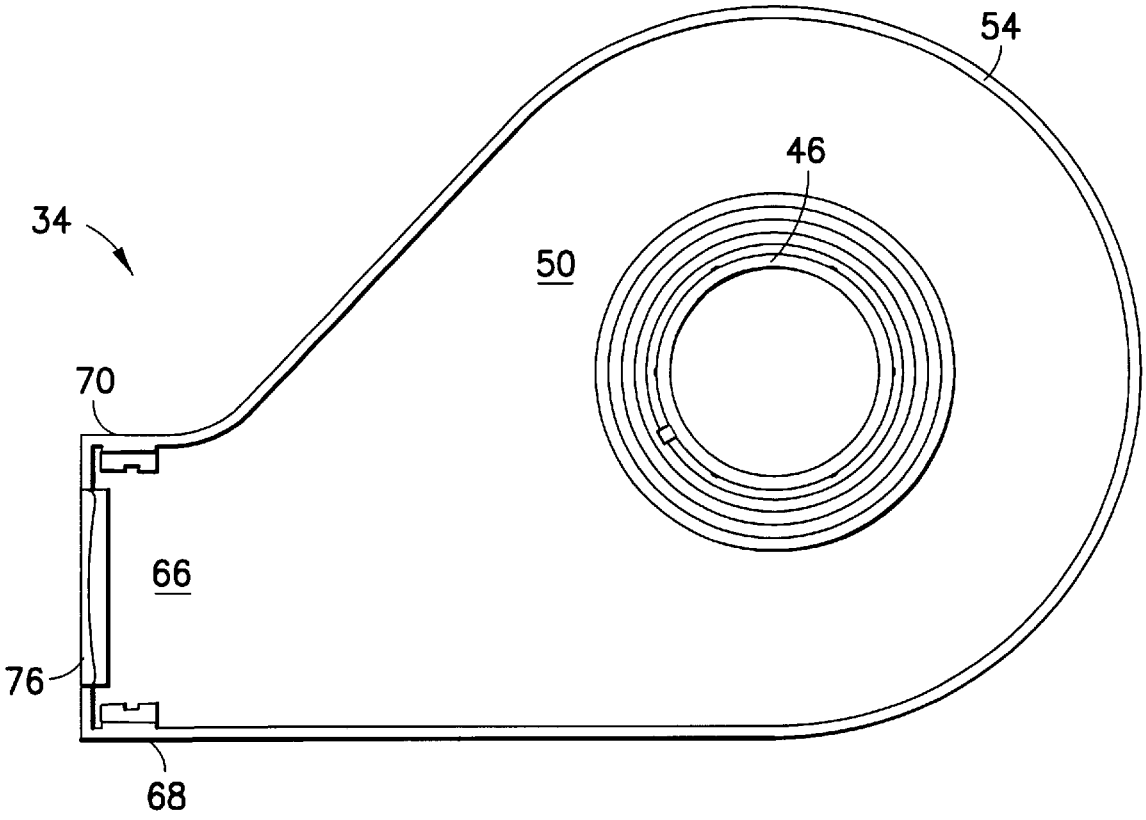
FIG. 8 is a top plan view of the bottom casing.
Figure 9:
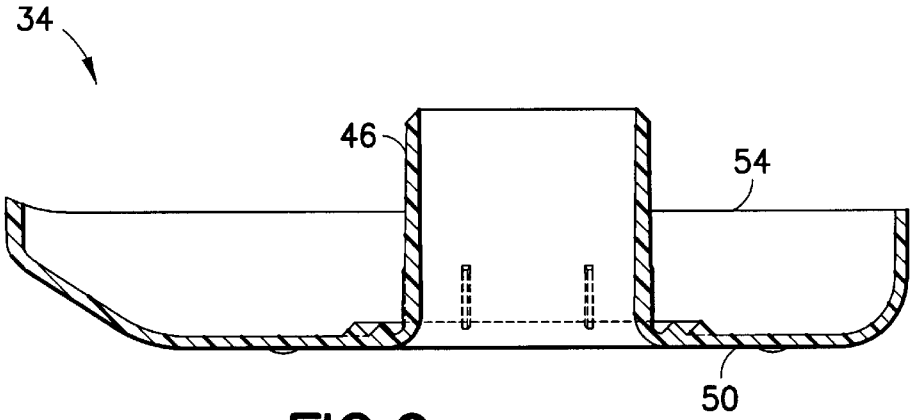
FIG. 9 is a cross-sectional view taken along line 9—9 in FIG. 8.

The blade support wall 84, as shown in FIG. 8, is formed with an array of unitary serrations 88 for severing the tape 12 as explained herein. In other embodiments, however, a separate metallic blade may be mounted to the blade support wall 84. With either embodiment, the serrations are disposed substantially at the extreme end of the blade support wall 84 and project downwardly. However, the blade support wall 84 includes an arcuate surface 90 extending substantially between the side walls 80 and 82 and projecting slightly below the serrations. Thus, as explained further herein, the arcuate wall 90 can be slid along the non-adhesive surface 16 of the tape 12, as the tape 12 is being applied to a substrate. After a sufficient length of the tape 12 has been applied, a simple rotation of the dispenser 10 enables the serrations to sever the tape 12 substantially at the precise intended location.

The dispenser is used by first disassembling the upper and lower casings of the dispenser 10, and inverting the upper casing 32. Thus, the tape roll chamber 38 will be open upwardly and the cylindrical sleeve 36 of the hub will project upwardly. The spool 22 of a roll of the tape 12 then is telescoped over the cylindrical sleeve 36 of the upper casing 32 such that the free end of the tape 12 projects in a clockwise direction. The proper orientation of the tape 12 is facilitated by arrows embossed into the inner surface of the upper casing 32. The free end of the tape 12 then is guided past the support rib 72 and is folded over the twist-generating wall 74. The proper folded orientation is illustrated by arrows embossed into the inner surface of the upper casing 32. In the folded orientation, the non-adhesive surface 16 of the tape 12 slides over the transverse twist-generating wall 74, and the tape 12 continues along the portion of the tape dispensing channel 40 defined by the upper casing 32. In particular, the tape 12 passes the upper trap wall 78 and is cantilevered toward the blade support wall 84. The tape 12 will assume a side-to-side curved configuration that helps to support the cantilevered tape 12 without direct adhesive affixation to any part of the upper casing 32. More particularly, the non-adhesive surface 16 of the tape 12 will abut both the transverse upper trap wall 78 and the blade support wall 84. The adhesive surface 14 of the tape 12 will face upwardly on portions of the inverted upper casing 32 between the twist-generating wall 74 and the blade support wall 84.

Figure 10:
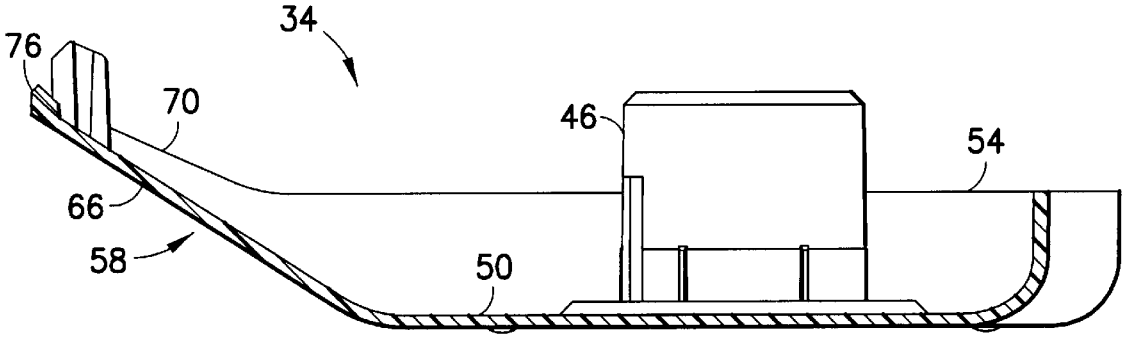
FIG. 10 is a cross-sectional view taken along line 10—10 in FIG. 8.
Figure 11:
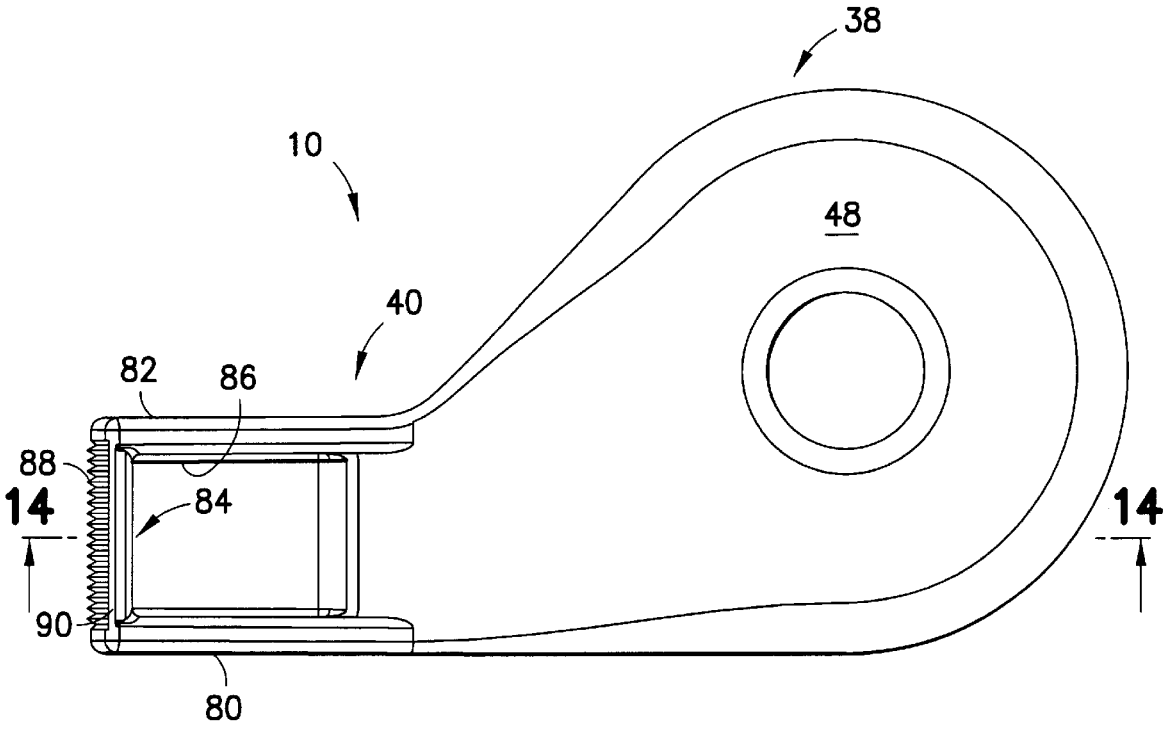
FIG. 11 is a top plan view of the assembled dispenser.
Figure 12:
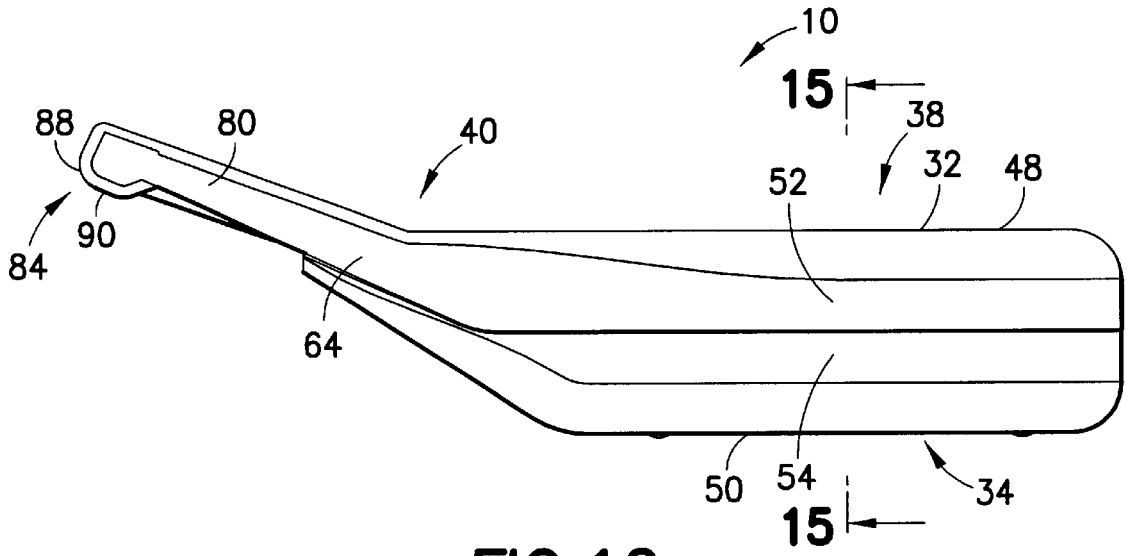
FIG. 12 is a side elevational view of the dispenser.

The lower casing 34 then is inverted and mounted onto the inverted upper casing 32. More particularly, the cylindrical sleeve 46 of the lower casing 34 is telescoped into the cylindrical sleeve 36 of the upper casing 32. Additionally, resiliently deflectable latches on the upper and lower casings 32 and 34 snap into releasable engagement with one another. In this assembled orientation, as shown in FIG. 10, the roll of the tape 12 is completely enveloped in the tape roll chamber 32 with the side walls 52 and 54 of the respective upper and lower casings 32 and 34 being aligned with one another and in edge-to-edge contact.

Figure 16:
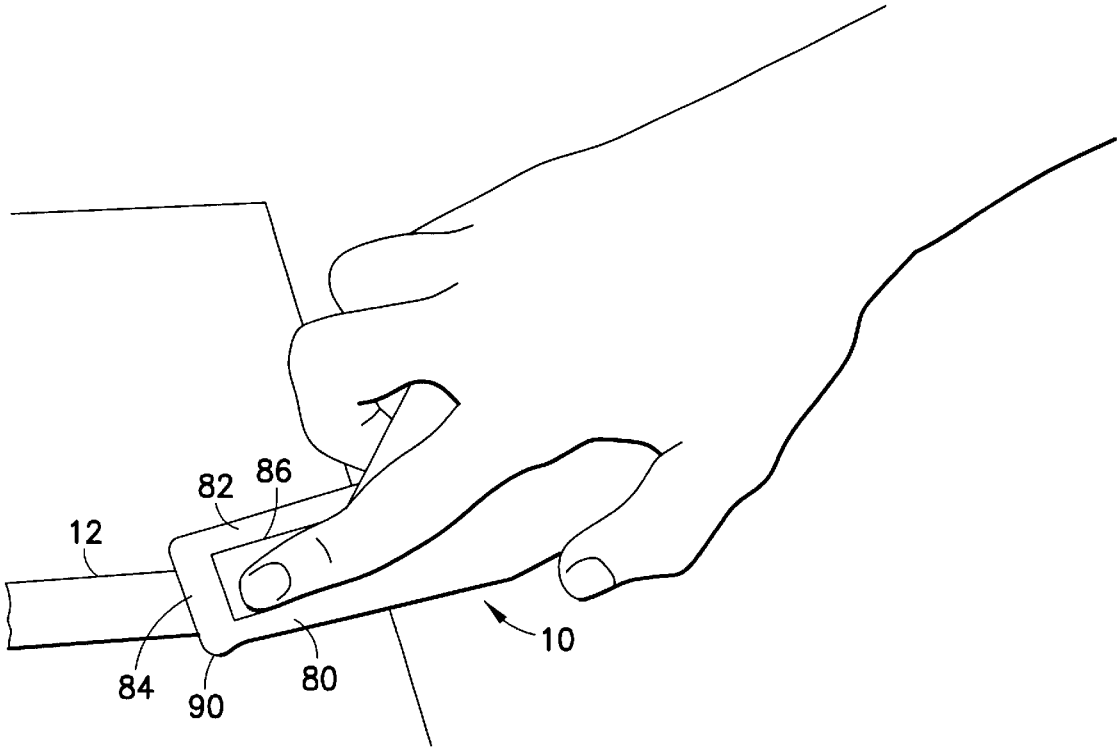
FIG. 16 is a perspective view of the dispenser in use.

The tape dispenser 10 may be used by turning the dispenser back to its proper orientation with the upper casing 32 above the lower casing 34 as shown in FIGS. 10–14. The user then may grip the tape roll chamber 32 with a thumb and fore fingers and may position the index finger adjacent the window 86 near the end of the tape dispensing channel 40 as shown in FIG. 16. The tape 12 is applied to a substrate by positioning the arcuate surface 90 of the blade support wall 84 on the substrate to be taped. The index finger then is urged into the window 86 and a force is applied to the non-adhesive surface 16 of the tape 12. This force urges the adhesive surface 14 of the tape 12 into proper position on the substrate that will be taped such that the adhesive surface 14 engages and adheres to the substrate at the selected location. The user of the dispenser 10 then merely moves his or her hand parallel to the tape dispensing channel 40 while sliding the arcuate lower surface 90 of the blade support wall 84 across the non-adhesive surface 16 of the tape. This movement simultaneously causes tape 10 to be dispensed and securely affixes the tape 12 to the substrate due to the light pressure applied by the arcuate lower surface 90 of the blade support wall 84. As the tape 12 approaches the location on the substrate at which the taping is to be terminated, the user then merely moves his or her hand to rotate the dispenser 10 substantially about the arcuate lower surface 90 of the tape support wall 84 so that the serrations 88 move into contact with the tape. The dispenser 10 then is rotated substantially about one or the other of the side arms 80 and 82 so that the serrations 88 tear through the tape.

The above-described angular alignment of the tape dispensing channel 40 relative to the tape roll chamber 38 and the axis "x" of the hub 36 enables accurate and close positioning of the tape 12 to the substrate for single handed application of the tape 12 to the substrate. Additionally, the sliding movement of the arcuate lower surface 90 of the blade support wall 84 ensures a secure even affixation of the tape 12 to the substrate. Furthermore, the existence of the window 86 relative to the tape 12 enables the user to position and affix the leading end of the tape 12 to the substrate without engaging the adhesive surface 14 of the tape 12.

While the invention has been described with respect to a preferred embodiment, it is apparent that various changes can be made without departing from the scope of the invention as defined by the appended claims. For example, the illustrated embodiment shows a dispenser with upper and lower casings that completely surround a roll of tape. However, the hub may have resilient fingers to releasably grip the spool, and only the upper casing may be provided.

What is claimed is:

1. A tape dispenser for an elongate strip of tape, said tape having a longitudinal axis and being wound onto a spool with a cylindrical opening defining a rotational axis, the longitudinal axis of the tape wound onto the spool defining a plane perpendicular to the rotational axis of the spool, the tape dispenser comprising:

a hub configured for insertion into the inner cylindrical surface of the spool for permitting the spool to rotate about the hub, a tape roll chamber at least partly surrounding the hub and a tape dispensing channel extending from the tape roll chamber, portions of the tape dispensing channel remote from the tape roll chamber defining a tape application section configured and aligned such that tape in the tape application section has its longitudinal axis aligned at an acute angle to the plane defined by the longitudinal axis of portions of the tape wound onto the spool;

wherein portions of the tape dispensing channel remote from the tape roll chamber define a blade support wall, a blade being disposed on the blade support wall for severing the tape;

and wherein the tape dispensing channel is formed to define a window between the blade support wall and the tape roll chamber, the window passing entirely through the tape dispensing channel.

2. The tape dispenser of claim 1, wherein the acute angle is between approximately 15° and 50°.

3. The tape dispenser of claim 2, wherein the acute angle is approximately 31°.

4. The tape dispenser of claim 1, wherein the blade is unitarily formed with the blade support wall.

5. The tape dispenser of claim 1, wherein the tape dispensing channel includes a guide wall configured for twisting the tape substantially 90° about the longitudinal axis of the tape.

6. The tape dispenser of claim 1, wherein the tape dispensing channel includes a blade for severing the tape, the blade being aligned substantially orthogonal to the rotational axis defined by the hub, the blade further being parallel to and offset from the plane defined by the longitudinal axis of the tape wound onto the spool.

7. A tape dispenser for an elongate strip of tape, said tape having a longitudinal axis and being wound onto a spool with a cylindrical opening defining a rotational axis, the longitudinal axis of the tape wound onto the spool defining a plane perpendicular to the rotational axis of the spool, the tape dispenser comprising:

a hub configured for insertion into the inner cylindrical surface of the spool for permitting the spool to rotate about the hub, a tape roll chamber at least partly surrounding the hub and a tape dispensing channel extending from the tape roll chamber, portions of the tape dispensing channel remote from the tape roll chamber defining a tape application section configured and aligned such that tape in the tape application section has its longitudinal axis aligned at an acute angle to the plane defined by the longitudinal axis of portions of the tape wound onto the spool, portions of the tape dispensing channel remote from the tape roll chamber defining a blade support wall, a blade being disposed on the blade support wall for severing the tape, the tape dispensing channel further being formed to define a window between the blade support wall and the tape roll chamber, wherein the blade support wall includes a convexly arcuate surface for applying pressure to tape dispensed from the tape dispenser.

8. A tape dispenser for an elongate strip of tape, said tape having a longitudinal axis and being wound onto a spool with a cylindrical opening defining a rotational axis, the longitudinal axis of the tape wound onto the spool defining a plane perpendicular to the rotational axis of the spool, the tape dispenser comprising:

a hub configured for insertion into the inner cylindrical surface of the spool for permitting the spool to rotate about the hub, a tape roll chamber at least partly surrounding the hub and a tape dispensing channel extending from the tape roll chamber, portions of the tape dispensing channel remote from the tape roll chamber defining a tape application section configured and aligned such that tape in the tape application section has its longitudinal axis aligned at an acute angle to the plane defined by the longitudinal axis of portions of the tape wound onto the spool, portions of the tape dispensing channel remote from the tape roll chamber defining a blade support wall, a blade being disposed on the blade support wall for severing the tape, wherein the tape dispensing channel includes an arcuate opening dimensioned for accommodating said tape dispensed from the tape roll chamber and forming said tape into an arcuate side-to-side configuration.

9. A tape dispenser having a cylindrical hub defining an axis of rotation, a tape roll chamber surrounding the hub, the tape roll chamber including opposed top and bottom walls substantially orthogonal to the axis of rotation and outer circumferential walls substantially surrounding the hub, a tape dispensing channel extending from the tape roll chamber, the tape dispensing channel having an end remote from the tape roll chamber, said end comprising a blade support wall having a blade thereon, portions of the tape dispensing channel adjacent the blade defining a tape dispensing path aligned at an acute angle to the axis of rotation defined by the hub, the tape dispensing path having a longitudinal direction aligned to the top and bottom walls of the tape roll chamber at an angle of between 15° and 50°, and wherein the blade is substantially parallel to the top and bottom walls of the tape roll chamber and is offset from the top wall of the tape roll chamber and on a side of the top wall opposite the bottom wall.

10. A tape dispenser having a cylindrical hub defining an axis of rotation, a tape roll chamber surrounding the hub, the tape roll chamber including opposed top and bottom walls substantially orthogonal to the axis of rotation and outer circumferential walls substantially surrounding the hub, a tape dispensing channel extending from the tape roll chamber, the tape dispensing channel having an end remote from the tape roll chamber, said end comprising a blade support wall having a blade thereon, portions of the tape dispensing channel adjacent the blade defining a tape dispensing path aligned at an acute angle to the axis of rotation defined by the hub, wherein portions of said tape dispensing channel between the tape roll chamber and the blade define an arched opening extending substantially transverse to the tape dispensing channel.

11. A tape dispenser having a cylindrical hub defining an axis of rotation, a tape roll chamber surrounding the hub, the tape roll chamber including opposed top and bottom walls substantially orthogonal to the axis of rotation and outer circumferential walls substantially surrounding the hub, a tape dispensing channel extending from the tape roll chamber, the tape dispensing channel having an end remote from the tape roll chamber, said end comprising a blade support wall having a blade thereon, portions of the tape dispensing channel adjacent the blade defining a tape dispensing path aligned at an acute angle to the axis of rotation defined by the hub, wherein portions of the tape dispensing channel adjacent the blade define a convexly arcuate tape pressing surface extending parallel to the blade.

12. A tape dispenser having a cylindrical hub defining an axis of rotation, a tape roll chamber surrounding the hub, the tape roll chamber including opposed top and bottom walls substantially orthogonal to the axis of rotation and outer circumferential walls substantially surrounding the hub, a tape dispensing channel extending from the tape roll chamber, the tape dispensing channel having an end remote from the tape roll chamber, said end comprising a blade support wall having a blade thereon, portions of the tape dispensing channel adjacent the blade defining a tape dispensing path aligned at an acute angle to the axis of rotation defined by the hub, wherein the tape dispensing channel includes an arcuate slot between the blade and the tape roll chamber, said arcuate slot being generated about an axis that is parallel to the tape dispensing channel.

13. A tape dispenser for an elongate strip of tape, said tape having a longitudinal axis and being wound onto a spool with a cylindrical opening defining a rotational axis, the longitudinal axis of the tape wound onto the spool defining a plane perpendicular to the rotational axis of the spool, the tape dispenser comprising:

a hub configured for insertion into the cylindrical opening of the spool for permitting the spool to rotate about the hub, at least one wall extending from the hub to define a gripping region of the dispenser at least partly surrounding the spool, a tape dispensing channel extending from the gripping region of the dispenser for dispensing the tape, at least one trap wall formed in the tape dispensing channel and aligned transverse to the longitudinal axis of portions of the tape disposed in the tape dispensing channel, the trap wall being configured to form the tape in the tape dispensing channel into an arched configuration, a pair of arms projecting beyond the trap wall and away from the gripping region of the tape dispenser, and a blade support wall extending between ends of said arm remote from said trap wall such that a window is formed between the trap wall, the blade support wall and the arms, a blade being on the blade support wall, whereby the trap wall enables the tape to be cantilevered at least partly across the window.

14. The tape dispenser of claim 13, wherein portions of the tape dispensing channel remote from the gripping region define a tape application section configured and aligned such that tape in the tape application section has its longitudinal axis aligned at an acute angle to the plane defined by the longitudinal axis of portions of the tape wound onto the spool.

15. A tape dispenser comprising:

a roll of adhesive tape, said roll comprising an elongate strip of tape defining a longitudinal axis, said strip of tape having opposite adhesive and non-adhesive sides, said roll further comprising a spool with an opening defining a rotational axis, the tape being wound onto the spool such that the longitudinal axis of the tape wound onto the spool defines a plane perpendicular to the rotational axis of the spool;

a tape roll chamber at least partly surrounding the tape roll, the tape roll chamber comprising a hub disposed in the opening of the spool such that the spool is rotateable about the hub;

a tape dispensing channel extending from the tape roll chamber and being dimensioned to accommodate a portion of the tape dispensed from the spool, a blade support wall defined at an end of the tape dispensing channel spaced from the tape roll chamber, a blade being disposed on the blade support wall, a trap wall disposed in the tape dispensing channel between the blade support wall and the tape roll chamber, the trap wall being configured to form the tape in the tape dispensing channel into a substantially arched configuration, a window extending through the tape dispensing channel at locations between the trap wall and the blade support wall, whereby the window enables digital forces to be applied to the non-adhesive side of portions of the tape disposed in the window for applying the adhesive surface of the tape to a substrate.

16. The tape dispenser of claim 15, wherein the blade support wall includes an arcuate bottom surface, the blade having a tape cutting edge directed toward the arcuate bottom surface in proximity to the arcuate surface of the blade support wall, the non-adhesive surface of a portion of the tape being substantially adjacent the arcuate surface of the blade support wall.

17. The tape dispenser of claim 16, wherein the longitudinal axis of the portion of the tape extending across the window is aligned at an acute angle to the plane defined by the longitudinal axis of portions of the tape wound onto the spool.

* * * * *